US005729949A

United States Patent [19]

Hartzheim

[11] Patent Number: 5,729,949

[45] Date of Patent: Mar. 24, 1998

[54] SLAB ON GRADE CHAIR

[76] Inventor: G. Douglas Hartzheim, 12390 Cambrin Dr., Yucaipa, Calif. 92399

[21] Appl. No.: 709,634

[22] Filed: Sep. 9, 1996

[51] Int. Cl.[6] ..... E04C 5/16

[52] U.S. Cl. ..... 52/677; 211/59.2; 221/307; 52/682; 52/687

[58] Field of Search ..... 52/677, 682, 683, 52/687, 689; 211/59.2; 221/307

[56] References Cited

U.S. PATENT DOCUMENTS

| | | | |
|---|---|---|---|
| D. 334,133 | 3/1993 | Hartzheim . | |
| 1,186,162 | 4/1916 | Hewitt et al. . | |
| 1,276,874 | 6/1918 | Dale et al. . | |
| 3,255,565 | 6/1966 | Menzel . | |
| 3,693,310 | 9/1972 | Middleton | 52/689 X |
| 4,000,591 | 1/1977 | Courtois . | |
| 4,483,119 | 11/1984 | Hernandez . | |
| 4,655,023 | 4/1987 | Yung | 52/687 X |
| 4,682,461 | 7/1987 | Sizemore . | |
| 4,756,641 | 7/1988 | Hartzheim . | |
| 5,107,654 | 4/1992 | Leonardis | 52/677 X |
| 5,201,869 | 4/1993 | Roethel | 221/307 X |
| 5,222,628 | 6/1993 | Roethel | 221/307 |
| 5,555,693 | 9/1996 | Sorkin | 52/687 X |

FOREIGN PATENT DOCUMENTS

| | | | |
|---|---|---|---|
| 227969 | 5/1960 | Austria . | |
| 575043 | 1/1946 | Sweden . | |
| 1428675 | 3/1976 | United Kingdom | 52/677 |

OTHER PUBLICATIONS

Product brochure from Dura-Tech of Dayton, Ohio for Plaschair and Grade Plate Spacers. (unknown).

Product brochure from Composite General, Inc. of Irving, Texas for Intersectional Chair, Mesh Chair and High Chair. (date unknown).

Product brochure from Lotel, Inc. of Baton Rouge, Louisiana for Mesh-Ups. (date unknown).

Product brochure from Hedlund Manufacturing Co. of Red Oak, Texas for PC.—Snap-On Paving Chairs. (date unknown).

Product brochure from WHC Products, Inc. of Houston, Texas for Stak Hi-Chair. (date unknown).

Product brochure from International Plastics, Corp. of Nicholasville, Kentucky for X High Chair, X Bar Chair and Joist Chair. (1991).

Product brochure from K.Y. Trading, Inc. of Los Angeles, California for Steel Spacer and Steel High Chair. (date unknown).

Product brochure from Spillman of Columbus, Ohio for Plasclips, Meshclips and Plaschairs. (Apr. 1994).

Product brochure from Art Mould Plastics, Ltd. of Ontario, Canada for Individual High Chairs and Individual Linden Chairs. (date unknown).

Product brochure from Craig's Construction Specialties, Inc. of Denver, Colorado for Mesh Chairs and Bar Chairs. (date unknown).

Product brochure from Seifert Abstandhalter of Schalksmuhle, Germany for Styrofix, Styrofix-Super and Styrofix-Extra. (date unknown).

Product brochure from Technique for Clip Type Spacer Clips, Spacer Chair and Support Chair. (date unknown).

Product brochure from Artikel of Wuppertal, Germany for Vierbein spacer. (date unknown).

Product brochure from Eclipse Plastic of Woodinville, Washington for Tower. (date unknown).

*Primary Examiner*—Wynn E. Wood

*Attorney, Agent, or Firm*—Knobbe, Martens, Olsen & Bear, LLP

[57] ABSTRACT

A chair for supporting and spacing reinforcement bars having a hollow-conical body for stackability, a planar base for support, an aperture allowing concrete to flow into and around the chair, and notches in the upper surface of the chair to retain the bars in the desired position.

25 Claims, 8 Drawing Sheets

SLAB ON GRADE CHAIR

BACKGROUND OF THE INVENTION

1. Field of the Invention

The present invention relates to a spacer, commonly referred to as a chair, for positioning reinforcement members a distance from a surface and, in particular, for locating reinforcement rods a specific distance from the surface of a mold used to form a concrete structure.

2. Description of Relevant Art

Spacers are generally designed to support and position reinforcement bars in concrete construction applications, such as the fabrication of concrete slabs or floors. Reinforcement bars are typically made of steel and usually range in size from ⅜ inch in diameter (a number 3 bar) to 2-¼ inches in diameter (a number 18 bar). These bars are usually arranged in rows or grids within a form into which concrete is to be poured. The reinforcement bars increase the strength and integrity of the concrete structure.

A chair that is placed directly on a graded soil surface or the ground is often referred to as a slab on grade chair. Slab on grade chairs are specifically designed to hold reinforcement bars at a preselected distance above such a surface and in relative position to other bars within the concrete form. Proper spacing of reinforcement bars, according to known engineering and architectural specifications, impacts the structural strength and integrity of the concrete structure. Additionally, proper spacing of the reinforcement bars from the outer surfaces of the concrete structure is beneficial because it helps prevent moisture, which may penetrate the concrete, from reaching the bars, which causes deterioration of the bar.

Prior spacers to position reinforcement bars within a concrete form are known. For example, U.S. Pat. No. 3,255,565 issued to Menzel discloses a tubular spacer having a head with a pair of diametrically opposed apertures for receiving and gripping a reinforcement rod. The base of the device disclosed in the Menzel patent is designed to support the head a preselected distance above a concrete form. The base of the device has a small footprint and is supported by three or four vertically extending legs. These slender legs hold the base of the device above the surface of the mold. In addition, the body of the device has no aperture other than those intended to hold the reinforcement bars.

Another known spacer is disclosed in U.K. Patent No. 1,276,874 issued to Dale and Wright which consists of a tube or pipe having multiple pairs of diametrically opposed holes which are drilled or punched into the tube. Each end of the tube has four notches or openings which causes the spacer to be supported by four thin legs. The tube has a constant diameter and is constructed of a rigid, plastic material. The holes or notches allow a single bar to be positioned at a specific height, or two or more bars to be located at different heights relative to a given surface. These bars may be positioned either parallel or perpendicular to each other. This device only allows concrete to flow into the spacer through the openings for the reinforcement bars.

Further, Canadian Patent No. 1,186,162 issued to Hewitt and Mitchell discloses a spacer for supporting concrete reinforcement rods. The spacer has a frusto-conical or tapered tubular body with two pairs of troughs or cut-outs on both the upper and lower surfaces of the spacer. This causes the spacer to be supported by four narrow legs. This device also only allows concrete to flow into the spacer through the openings for the reinforcement bars.

It is known that large numbers of spacers, often in the hundreds or thousands for large construction projects, may be required. Known spacers generally require a large storage area and are expensive to transport because existing spacers are either solid or constructed with external or internal structures which prevent stacking or permit only marginal stacking. The burden and expense of storing and transporting hundreds or thousands of known spacers is great. Additionally, the bulk of known spacers makes it difficult for an installer to carry more than several conventional spacers at one time. Consequently, the installer must make frequent trips to the storage area to pick up more spacers. This is costly and inefficient.

SUMMARY OF THE INVENTION

In accordance with one aspect of the invention, the slab on grade chair is an improved device for positioning and supporting reinforcement members in a mold. The chair has a hollow-conical body with an attached foot portion for secure support of the chair on a variety of surfaces, including graded soil surfaces. The upper surface of the chair has one or more notches configured to receive the reinforcement rod. Preferably, the upper surface has two or more pairs of opposed notches which have a different depth or radius of curvature to support reinforcement rods at different heights. A continuous band of material in the body portion of the chair surrounds these notches to advantageously enhance the strength of the chair.

Another aspect of the invention includes a chair having a generally hollow-conical body with a plurality of support legs extending from the body to the foot portion. Advantageously, a plurality of openings are disposed between the support legs to allow concrete or similar materials to flow into the interior surface of the chair. This allows the concrete or other similar material to completely fill the interior of the chair, which increases the strength of the structure.

Yet another aspect of the invention includes a chair having a generally hollow-conical body having a longitudinal axis. Extending from the body is a plurality of support legs, and attached to the support legs are foot portions. The foot portions preferably extend generally outwardly from the longitudinal axis. These foot portions are preferably interconnected to form a base having a generally circular central opening. The radius of curvature of the support legs is preferably greater than the radius of curvature of the central opening of the base which advantageously allows the chair to support a greater weight than if the radius of curvature of the legs was the same as the central opening.

Still another aspect of the present invention is that the chairs are readily stackable. This advantageously minimizes the amount of shipping and storage space required for the chairs. This is a significant advantage over known chairs which require much larger spaces for shipping or storage. Further, the stackability of the present invention advantageously allows an installer to carry many chairs at one time. This allows a worker to place numerous chairs at a construction site without repeated trips to a storage area for additional chairs.

Still another aspect of the invention is it can be placed on loose or pliant surfaces, such as sand, and still maintain proper positioning above the grade. Most known spacers, on the other hand, are constructed without foot portions or a base, and they sink into such surfaces under the weight of the reinforcement bars or workers who step on the bars or chairs. For instance, the spacers disclosed in the Dale and Wright and the Hewitt and Mitchell patents do not have foot portions. Thus, these chairs can only be used on hard surfaces. Additionally, the spacer disclosed in the Menzel patent has slender legs with a small footprint, which is unsuitable for use on soft surfaces. Accordingly, these spacers can generally only be used on a hard surface. Other known spacers have a base, but the base is at the expense of stackability, e.g., the spacer has a solid base. The chair according to the present invention advantageously incorporates a foot structure which allows stackability. Further, the hollow-conical shape, the absence of protruding structure on the inner and outer surfaces of the chair, and the curvature of the support legs facilitate maximal stackability of this chair. Therefore, this embodiment of the present invention provides foot portions in combination with a chair that is readily stackable to minimize storage and transportation costs.

It is also known that chairs must be constructed so as not to create a fracture plane or weak point in the finished structure, such as a concrete slab. Such a fracture plane can be caused by anomalies such as internal gaps or air trapped in the concrete structure. To eliminate this problem, another aspect of the present invention allows concrete to freely flow through large apertures in the chair. These apertures preferably have wide openings, in trapezoidal/triangular or wide arching shapes, for example, which provide for the free flow of the concrete into and about the chair without sacrificing the strength of the chair. Significantly, this allows the reinforcing rod to be fully encased by concrete which strengthens the structure by eliminating the internal abnormalities.

Further, it is quite common for workers to step on the bars or the supporting chairs during construction. Consequently, substantial force is exerted on the chairs. Thus, the chairs must be both strong and resilient. Some commercially available chairs are made of steel rod, which, while strong, are ruined if bent or deformed. Other known plastic spacers do not have the strength to accommodate this force. Thus, another aspect of the invention is to construct the chair of a resilient material, such as plastic for toughness and strength. In addition, structural features, such as the specially shaped apertures and the curvature of the support legs supplement the strength of the chair. Significantly, the present invention eliminates the need to use expensive materials for sufficient structural integrity.

Still yet another aspect of the present invention is to provide a plurality of stacked chairs within a container. The container advantageously allows a number of chairs to be stored and transported within a minimum area. The container may also allow a single chair to be dispensed at a time. This advantageously allows a worker to easily carry a number of chairs and dispense a single chair at the desired location.

DETAILED DESCRIPTION OF THE PREFERRED EMBODIMENT

Figure 1:
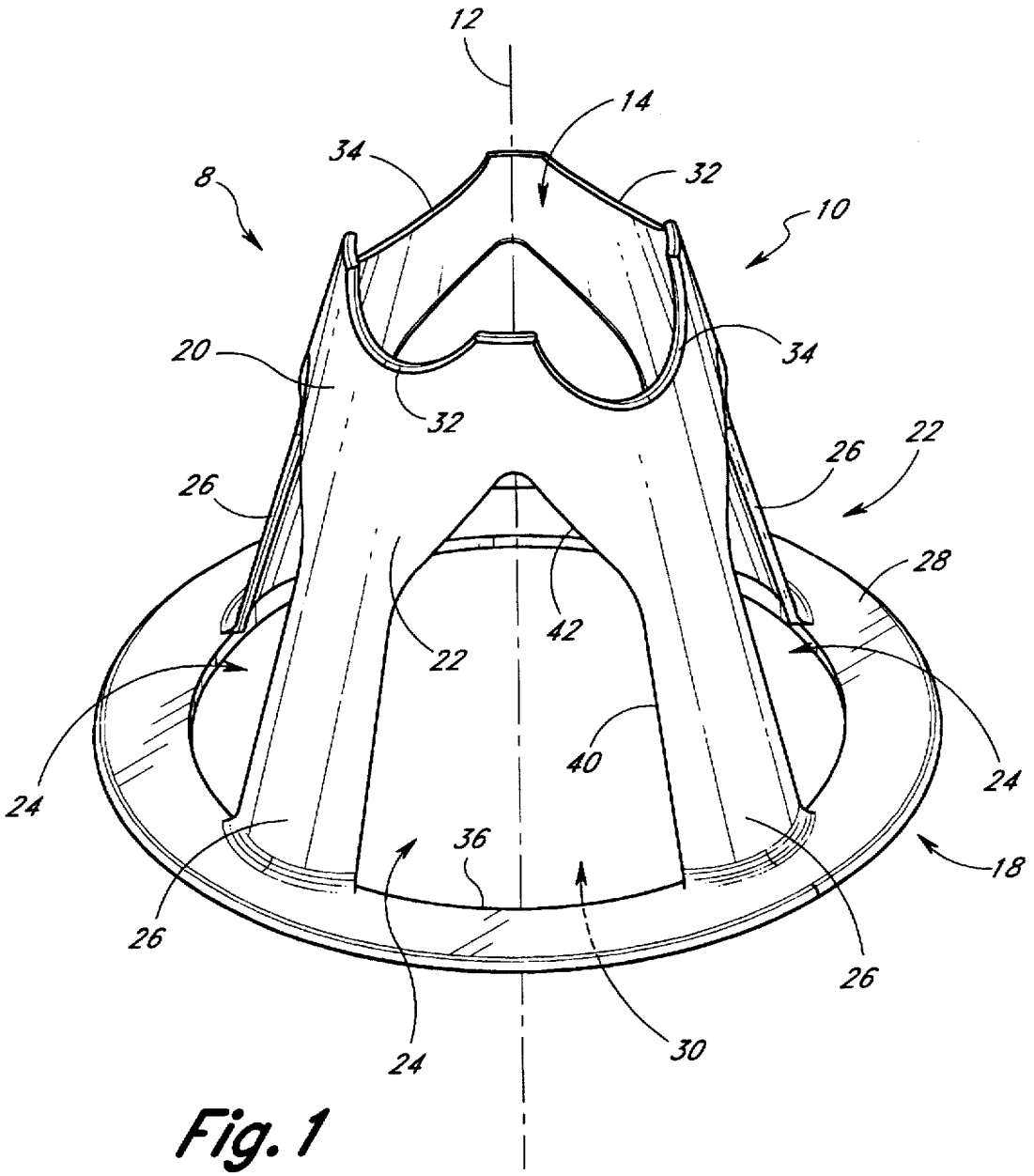
FIG. 1 is a perspective view of an embodiment of the chair according to the present invention.
Figure 2:
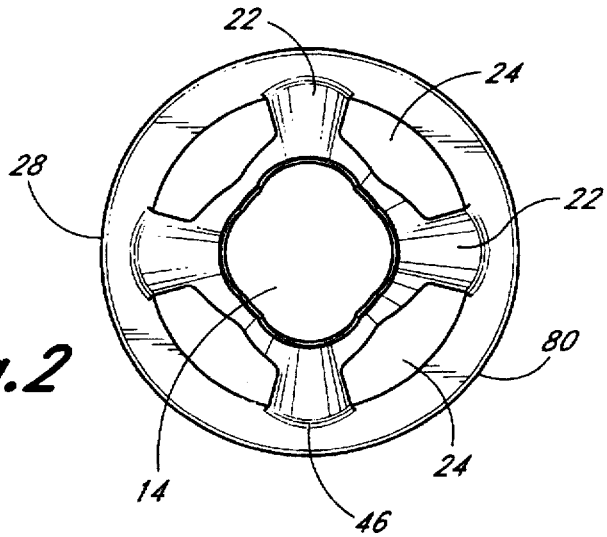
FIG. 2 is a top view of the chair in FIG. 1.
Figure 3:
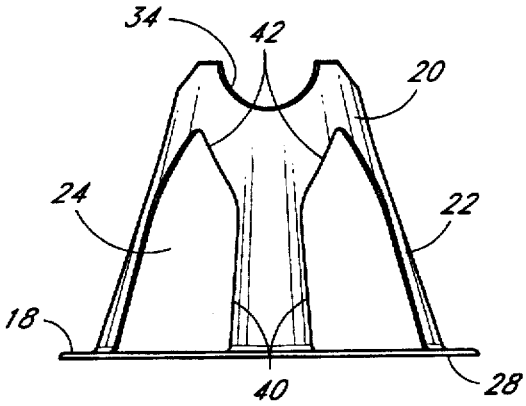
FIG. 3 is a front elevation view of the chair in FIG. 1.

The slab-on-grade chair 8 according to the present invention, as illustrated in FIGS. 1 through 5, consists of a hollow-conical body 10 which is symmetrical about a longitudinal axis 12. The body 10 has an upper opening 14, a lower end 18, a continuous wall portion 20 located proximate the upper opening 14 and a support portion 22 located between the continuous wall portion 20 and the lower end 18. Preferably, four side apertures 24 are evenly spaced around the support portion 22 creating four support legs 26. It will be readily appreciated by one of ordinary skill in the art that any number of side apertures 24 and support legs 26 may be located between the wall 20 and lower end 18. Attached to the lower end 18 of the body 10 is a foot portion 28. The foot portion 28 is preferably connected to support legs 26 and extends generally outward from the longitudinal axis 12. As seen in FIG. 1, the foot portion 28 preferably forms a generally planar base that extends radially outward from the support legs 26. The base or foot portion 28 has a lower opening 30 which is preferably larger than the upper opening 14, and this lower opening 30 generally coincides with the perimeter formed by the support legs 26 at the lower end 18 of the body 10.

A pair of notches 32 are cut into the continuous wall portion 20 along the upper opening 14. A pair of notches 34 may also be cut into the continuous wall portion 20. The notches 34 are preferably aligned ninety degrees from the notches 32. It will be appreciated that the notches 32 and 34 may be in any preferred respective alignment. In addition, any number of notches may be cut into the wall 20. Further, the notches may be of different depths such that the distance from the bottom of the notch to the base 28 is varied. For instance, as seen in FIG. 1, the distance from the bottom of notch 34 to the base 28 is less than the distance from the bottom of notch 32 to the base 28. The notches may also have a different radius to support reinforcement rods of different radii.

The hollow-conical body 10 with the upper opening 14 and lower opening 30 permits stacking of the chairs 8. For instance, the upper portion of a first chair may be inserted through the lower opening 30 of a second chair. One of ordinary skill in the art will recognize that the chair 8 of the present invention can be formed with any number of hollow and tapered body shapes which also permit stacking. For example, the chair 8 of the present invention may include not only a conical body having a generally circular cross-section, but also a body having multiple straight sides and a polygonal cross-section. The chair may also have an elliptical, oval or hybrid cross section, such as a square with rounded corners.

One of ordinary skill in the art will also recognize that a variety of notch sizes and shapes in the upper surface can be implemented in the chair 8 of the present invention. For instance, smaller notches with steeper sides may more readily retain a bar at an exact position, but preclude the use of larger diameter bars. By contrast, larger notches with sides having a more gradual slope will accommodate both large and small diameter bars. The bars, however, will more readily shift position within such a notch. These variations are illustrated in FIGS. 1 through 13.

Specifically, referring to the embodiment of FIGS. 1 through 5, the notches 32 and 34 are roughly semi-circular in shape. A second embodiment of the chair of the present invention is shown in FIGS. 6 through 9. In the second embodiment, the shallow notches 132 and the deep notches 134 are less semi-circular and more arc-like than the embodiment of FIGS. 1 through 5, having more gradually-sloping sides. A third embodiment of the chair according to the present invention is shown in FIGS. 10 through 13. In this embodiment, the shallow notches 232 and deep notches 234 are narrow with steep sides. It will be understood that the notches can have steeper or more gradual curvatures than those shown in FIGS. 1 through 13. One of ordinary skill in the art will recognize a variety of other notch shapes other than semi-circular or arc-like shapes can be implemented. For example, notches with square sides and corners, notches which resemble inverted triangles or notches with a flexible narrow opening configured to secure the rod within the notch can be implemented. As discussed above, one of ordinary skill in the art will also recognize that any number of notches can be utilized and the notches may have different depths and radii.

One of ordinary skill in the art will also recognize that the apertures 24 may be of a variety of configurations. For instance, in the embodiment illustrated in FIGS. 1 through 5, the apertures 24 have a generally trapezoidal lower portion 40 and a generally triangular upper portion 42. This aperture shape is designed to maximize the size of the apertures 24 while providing support legs 26 of sufficient size as not to compromise the chair's strength. The large openings 24 maximize the free flow of concrete or other similar material into and around the chair 8, which reduces the possibility of fracture plane formation. The support legs 26 provide the ability to support larger and heavy bars, and to withstand the force when the bars and chairs are stepped-on by workers during the construction process. Preferably, the trapezoidal portion 40 generally follows the taper of the conical body, thus allowing sufficient material in the support legs. The triangular portion 42 preferably allows for notches on either side of the apertures and a large opening between the notches, yet still provides sufficient material in the wall portion for strength. Another embodiment of the chair 8 according to the present invention is shown in FIGS. 14 through 17. In this embodiment, the apertures 324 are wide arches. The arches 324 may also be located over trapezoidal portions which generally follow the taper of the conical body. One of ordinary skill in the art will recognize that a variety of sizes, shapes and number of apertures can be implemented. For instance, there can be more but smaller apertures than those illustrated in the figures, and the apertures can be circles, ovals, polygons and the like.

In the embodiment illustrated in FIGS. 1 through 5, the foot portion 28 forms a base which is generally disc-shaped. The base preferably extends radially outward from the longitudinal axis 12 and has a lower opening 30 with a circular curvature 36. The foot portion 28 has a large footprint to prevent the chair 8 from sinking into soft grade material when force is applied to the chair. For example, a chair 8 that is designed to support a bar about 3 inches above a surface preferably has a base that extends radially outward between about 0.125 and 1.0 inches from the lower opening 30. More preferably, the base extends between about 0.25 and 0.5, and most preferably the base extends about 0.375 inches from the lower opening 30. One of ordinary skill in the art will recognize that other sizes and planar shapes, such as rectangles, polygons and the like could also be utilized for the base. Another embodiment of the invention, shown in FIGS. 18 through 21, has a horizontally extended foot portion 450 that extends outwardly from each support leg 426. In this embodiment, there is no interconnection of the foot portions 450, but the foot portions 450 allow the body to be free-standing while supporting the chair on soft grade material.

Figure 4:
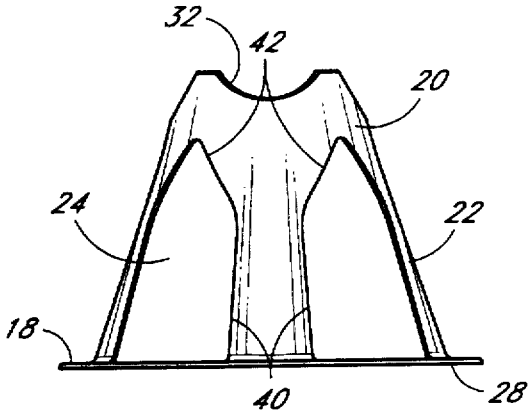
FIG. 4 is a side elevation view of the chair in FIG. 1.
Figure 5:
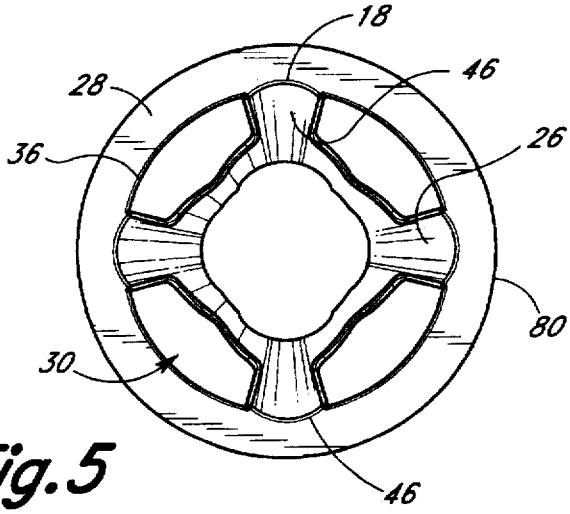
FIG. 5 is a bottom view of the chair in FIG. 1.
Figure 6:
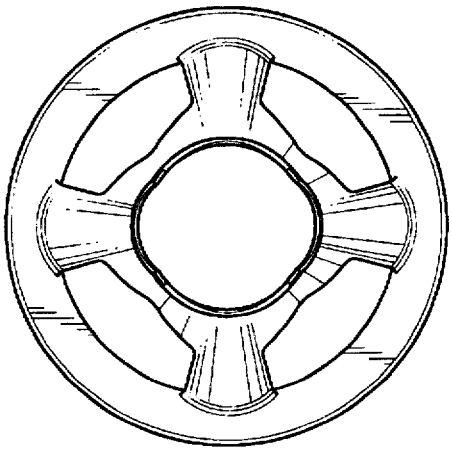
FIG. 6 is a top view of a second embodiment of the chair according to the present invention.
Figure 7:
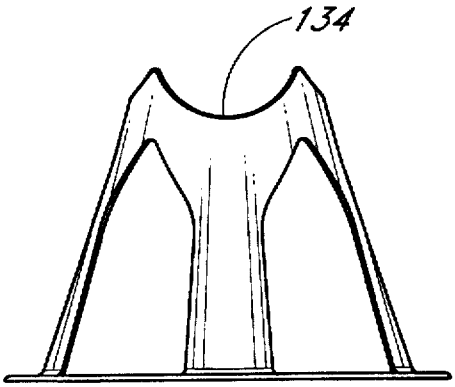
FIG. 7 is a front elevation view of the chair in FIG. 6.
Figure 8:
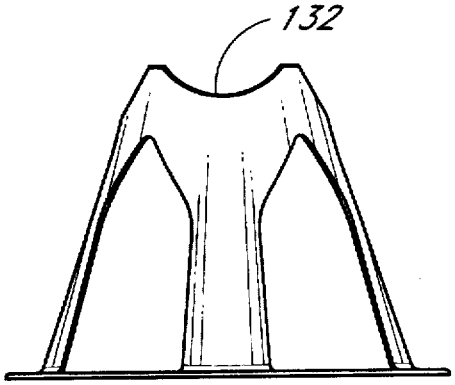
FIG. 8 is a side elevation view of the chair in FIG. 6.
Figure 9:
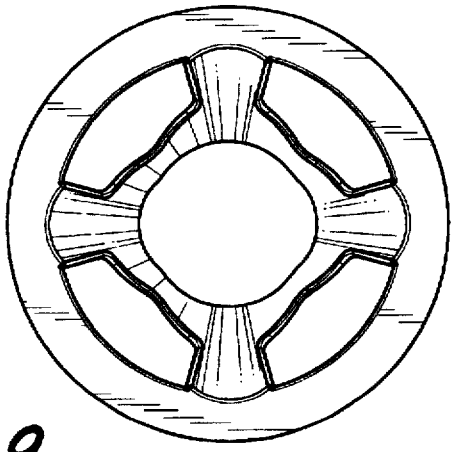
FIG. 9 is a bottom view of the chair in FIG. 6.
Figure 10:
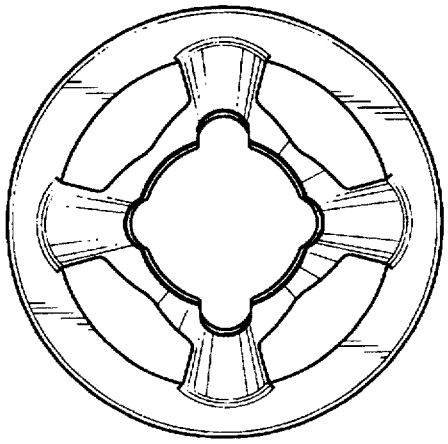
FIG. 10 is a top view of a third embodiment of the chair according to the present invention.
Figure 11:
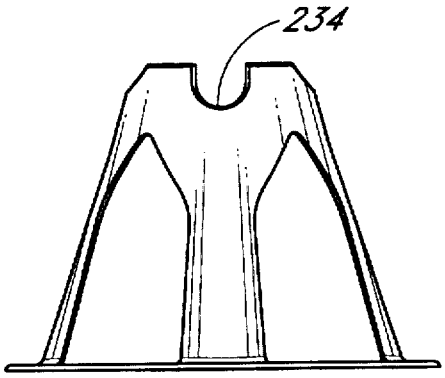
FIG. 11 is a front elevation view of the chair in FIG. 10.
Figure 12:
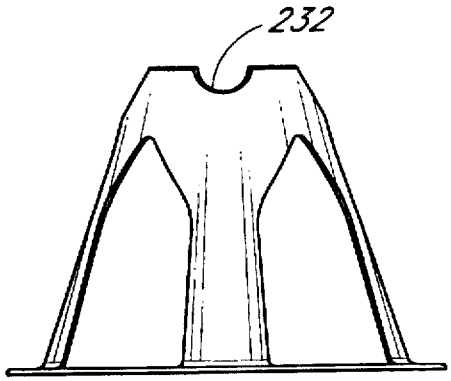
FIG. 12 is a side elevation view of the chair in FIG. 10.
Figure 13:
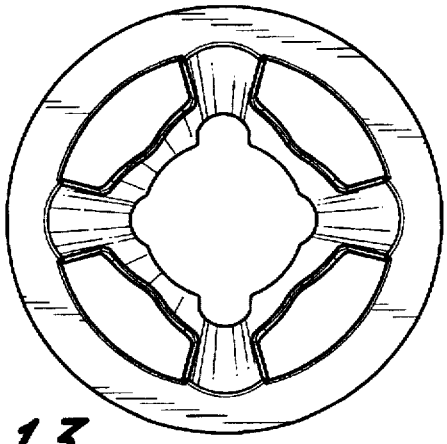
FIG. 13 is a bottom view of the chair in FIG. 10.
Figure 14:
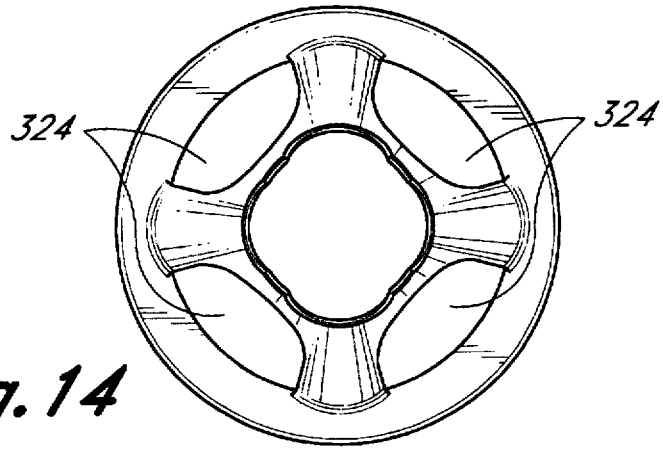
FIG. 14 is a top view of a fourth embodiment of the chair according to the present invention.
Figure 15:
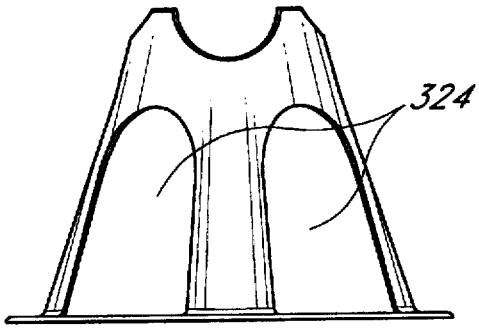
FIG. 15 is a front elevation view of the chair in FIG. 14.
Figure 16:
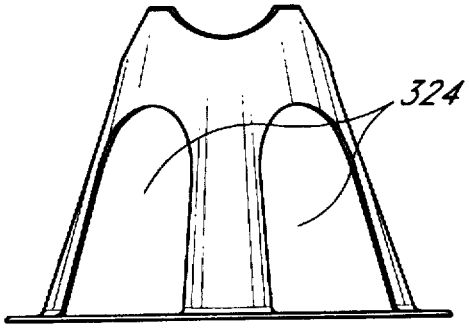
FIG. 16 is a side elevation view of the chair in FIG. 14.
Figure 17:
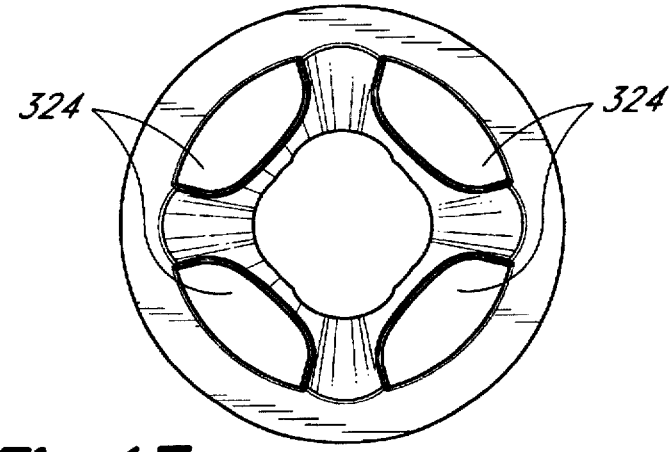
FIG. 17 is a bottom view of the chair in FIG. 14.
Figure 18:
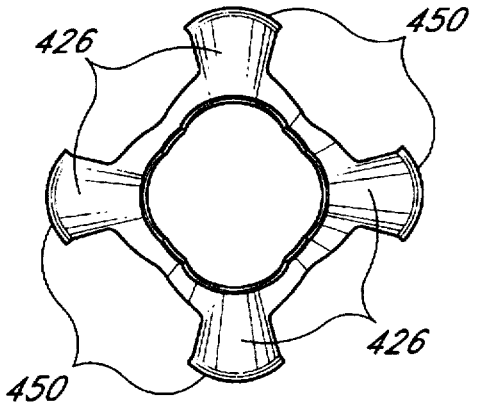
FIG. 18 is a top view of a fifth embodiment of the chair according to the present invention.
Figure 19:
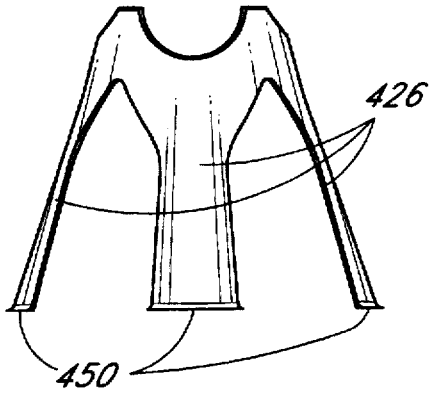
FIG. 19 is a front elevation view of the chair in FIG. 18.
Figure 20:
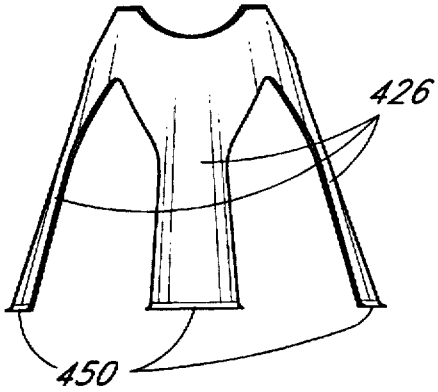
FIG. 20 is a side elevation view of the chair in FIG. 18.
Figure 21:
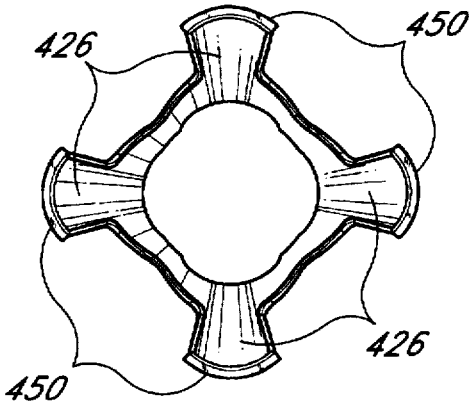
FIG. 21 is a bottom view of the chair in FIG. 18.

Referring back to FIGS. 1 through 5, the support legs 26 preferably have a inner curvature 46 which is greater than the circular curvature 36 of the lower opening 30. This greater leg curvature 46 advantageously gives the support legs 26 increased strength than if the leg curvature 46 were the same as the circular curvature 36 of the lower opening 30. This greater leg curvature 46 also advantageously facilitates the stackability of the chair, as described below. Referring to FIG. 4, the support legs 26 and the continuous wall portion 20 slope at substantially the same angle from the foot portion 28. Further, the support portion 22 has an inner and outer surface or wall having substantially the same slope.

Further, the chair 8 is preferably constructed from a resilient material and, more preferably, is constructed of a plastic or resin material. Most preferably, the chair is made of polypropylene and is one-piece injection molded. One of ordinary skill in the art will recognize that other materials exhibiting similar characteristics of being lightweight, strong and resilient can be used, such as polyethylene, a combination of polypropylene and polyethylene, and other known materials.

Figure 22:
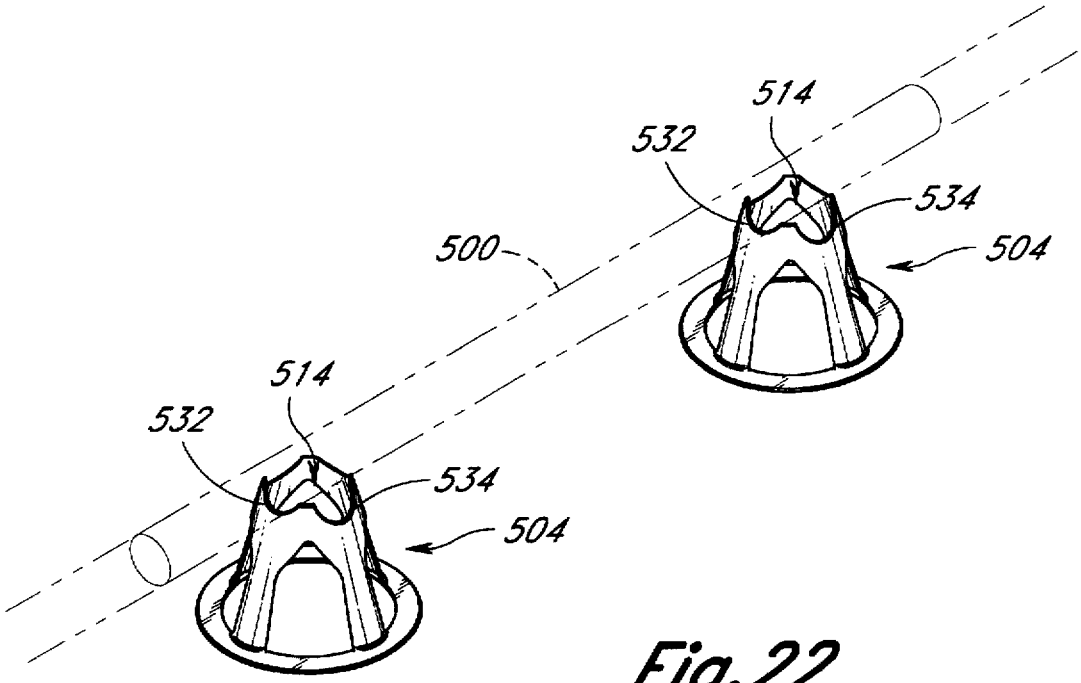
FIG. 22 is a perspective view illustrating the use of two chairs to position and support a reinforcement bar.

Referring to FIG. 22, a typical use of the chair according to the present invention involves positioning a reinforcement bar 500 across the upper openings 514 of multiple chairs 504. The chairs 504 are preferably aligned such that the bar 500 rests within either the shallow notches 532 or the deep notches 534. The height of the bar from the grade surface is determined by which pair of notches is used to position the bar. The greater bar height is achieved with the shallow notches 532 and the lesser height is achieved with the deep notches 534. In this manner, a single chair structure can be used to set bars at one of two predetermined heights above the grade. In a typical application, the bar is placed within the identical notch pairs of each chair. It will be understood that a chair may have any number of notches and of different sizes and shapes. The chair 504 may support only a single bar, as shown in FIG. 22, or it may support a plurality of bars as part of a grid. Additionally, the bar may rest freely in the notch or it may be retained by a separate device, such as a wire wrapped around the bar and the chair. Alternatively, a retaining device may be incorporated as an integral part of the chair, such as a combination of a toothed strap and a ratcheted catch. In such an embodiment, a bar could be placed in a notch and the toothed strap is then placed over the bar and engaged with the catch to secure the bar within the notch.

Figure 23:
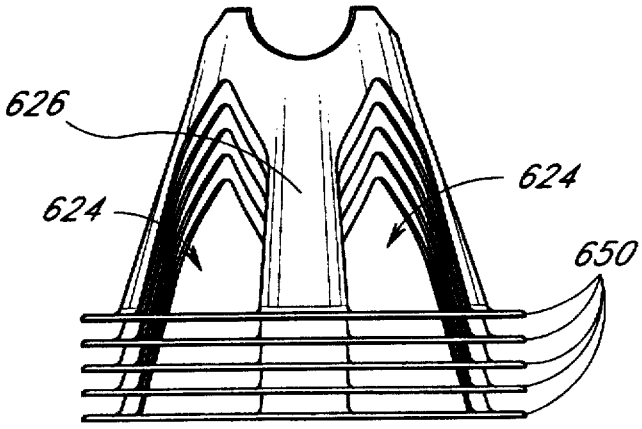
FIG. 23 is a perspective view illustrating chairs in a stacked configuration for transportation, storage and handling.

As illustrated in FIG. 23, multiple chairs 650 can be stacked onto each other. A first chair is stacked on top of a second chair by placing the lower opening of the first chair over the upper opening of the second chair and inserting the second chair inside the first chair, bringing the bases of the first and second chairs into close proximity. The present invention facilitates stackability because the large lower opening in the base allows the second chair to be fitted inside the first chair. Significantly, the absence of material protruding from either the inner or outer portion of the body, other than the base, allows the second chair to be fitted almost completely within the body of the first chair.

Additionally, the leg curvature 46, which is greater than the curvature 36 of the lower opening 30, forces the stacked chairs to align coincident with their support legs 26. Misalignment results in a larger distance between the bases of adjacently stacked chairs because the leg curvature 46 of an inside-stacked chair presents a greater overall diameter to the lower opening 30 of an outside-stacked chair than if the support legs 26 are aligned. When the support legs 26 are aligned, the chairs 8 nest with a minimum space between adjacent bases. For instance, chairs that are designed to support a rod about 3 inches above a surface are preferably stacked such that less than about 1 inch separates adjacent bases. More preferably, the chairs are stacked with less than about 0.5 inches and most preferably less than 0.25 inches between adjacent bases. Thus, the chairs 8 form an organized and tightly clustered stacking arrangement, allowing a larger number of chairs to be stored and transported in a minimum amount of space. This also allows a combination of two or more stacked chairs to be utilized as a single chair to accommodate greater heights above grade than a single chair. For example, two stacked chairs can be configured such that their respective shallow notches are aligned, providing an increase in bar height from the graded surface. Further, the stacked chairs do not tend to rotate because the curved inner surfaces of adjacent support legs are engaged. This advantageously creates a stable base for the stacked chairs to support a reinforcement rod.

Figure 24:
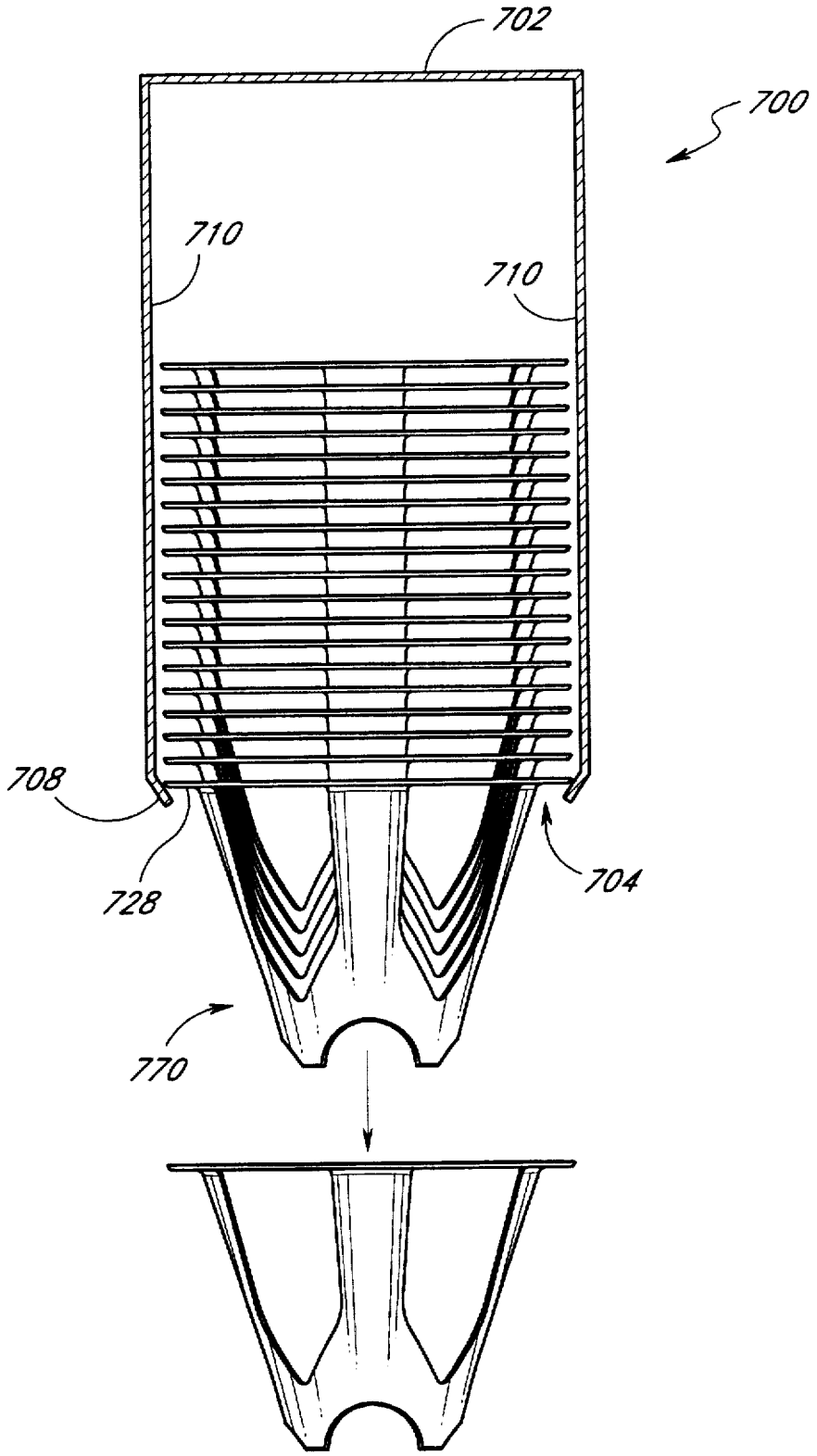
FIG. 24 is a side view of a chair dispenser containing a chair stack.

FIG. 24 illustrates another embodiment of the present invention which includes a container 700 configured to store, transport and dispense chairs 770. The container 700 has a first end 702, a second end 704 and a generally circular wall 710 which generally conforms to the shape of the base 728 of the chair 770. A lip 708 proximate the second end 704 of the container 700 grips the base 728 of the chair 770 such that a force is required to remove the chair 770 from the container 700. This allows a single chair 770 to be removed at one time. Because the base is the widest portion of the chair, only the outer perimeter of the base is located proximate the inner wall 710 of the cylindrical container 700. This minimizes friction between the chair 770 and the container 700 and allows for easy chair removal. The container 700 may be constructed from a generally rigid material, or a thin flexible plastic material which is sealed at one end and twist-tied at the other end. The chairs may be retained inside the container 700 by a band of material proximate the container open end 704.

One of ordinary skill in the art will recognize that the container can also be constructed from a variety of semi-rigid or rigid materials. Further, a variety of optional retaining means can be implemented in addition to the lip 708 shown in FIG. 24. For example, the retainer can be an elastic material at the open end of the container, a narrowed area of container material near the container open end, or protruding structure on the inner wall, such as spiral threads. Those of ordinary skill will also recognize that containers with other than circular cross-sections can be utilized to store chairs with the non-circular bases described above.

The method of storing, transporting and dispensing chairs according to the present invention involves stacking a plurality of chairs and storing them in the container, such as that illustrated in FIG. 24. Groups of such containers can then be transported to a construction site where concrete slabs or like structures are to be formed. Once reinforcement bars are laid within a form, the position of each required chair and the corresponding bar height are determined. A construction worker can then carry one or more tubes of chairs while walking along the rows and/or grids of reinforcement bars, dispensing a single chair and placing it in position at each identified location.

The present invention has been disclosed in detail in connection with the preferred embodiments, but these embodiments are disclosed by way of examples only and are not to limit the scope of the present invention, which is defined by the claims that follow. One of ordinary skill in the art will appreciate many variations and modifications within the scope of this invention.

What is claimed is:

1. A chair for supporting and spacing reinforcement members, comprising:

a substantially hollow-conical body having a longitudinal axis, a continuous wall portion defining an upper opening, a lower end, an inner surface, an outer surface, and a support portion disposed between said continuous wall portion and said lower end, said support portion defining a side aperture, said support portion having an inner and an outer surface having substantially the same slope;

at least one notch in said continuous wall portion; and at least one foot portion connected to said body at said lower end, said at least one foot portion defining at least a portion of a lower opening which is larger than said upper opening, said foot portion extending outwardly from said longitudinal axis.

2. The chair of claim 1, wherein said at least one foot portion comprises a single foot portion which forms a generally continuous base.

3. The chair of claim 2, wherein said base is generally planar.

4. The chair of claim 3, wherein said base includes a generally circular inner opening with an inner radius of curvature, wherein said support portion comprises a plurality of support legs, said support legs have an inner radius of curvature, said inner radius of curvature of said base is greater than said inner radius of curvature of said support legs.

5. The chair of claim 1, wherein said support portion comprises a plurality of support legs, said support legs defining a plurality of side apertures generally disposed between said support legs.

6. The chair of claim 5, wherein each of said support legs has a leg curvature and said continuous wall portion has a wall curvature, said leg curvature being greater than said wall curvature.

7. The chair of claim 1, wherein said aperture has a substantially trapezoidal-shaped lower portion and a substantially triangular-shaped upper portion.

8. The chair of claim 1, wherein said aperture has an arch-shaped upper portion.

9. The chair of claim 8, wherein said aperture has a substantially trapezoidal-shaped lower portion.

10. The chair of claim 1, further comprising a first pair and a second pair of opposed notches in said continuous wall portion, said second pair being oriented ninety degrees from said first pair of notches.

11. The chair of claim 1, further comprising a plurality of notches in said continuous wall portion.

12. The chair of claim 11, further comprising a plurality of pairs of diametrically opposed notches.

13. The chair of claim 12, wherein each of said pairs of notches has a different depth.

14. The chair of claim 1, wherein said body is one of a plurality of bodies, said bodies being stackable for storage and transport.

15. The chair of claim 14, wherein said bodies are stacked in a single stack such that each longitudinal axis of each body is coincident.

16. A chair for supporting and spacing reinforcement members comprising:

a substantially hollow-conical body having a longitudinal axis, a continuous wall portion defining an upper opening and a lower end;

a plurality of support legs disposed between said continuous wall portion and said lower end defining a plurality of apertures disposed between said support legs, said support legs each having a leg curvature and said wall portion having a wall curvature such that said leg curvature is greater than said wall curvature;

a plurality of notches in said continuous wall portion; and a radially outward extending base connected to said body at said lower ends, said base defining a generally circular lower opening larger than said upper opening.

17. The chair of claim 16, further comprising a plurality of diametrically opposed notch pairs in said continuous wall portion.

18. The chair of claim 16, wherein said base extends outwardly from said longitudinal axis.

19. The chair of claim 16, wherein said generally circular opening of said base has an inner radius of curvature, wherein said support legs have an inner radius of curvature, said inner radius of curvature of said base is greater than said inner radius of curvature of said support legs.

20. The chair of claim 16, wherein said apertures have a substantially trapezoidal-shaped lower portion and a substantially triangular-shaped upper portion.

21. Two or more chairs which support and space reinforcement members, the chairs stack for storage or transportation, comprising:

a first chair having a substantially hollow-conical body, said body having an upper opening and a plurality of support legs, said support legs attached to a radially outward extending base, said base having a central opening, said support legs having an inner wall, an outer wall and a leg curvature, said inner wall and said outer wall having substantially the same slope; and a second chair having a substantially hollow-conical body, said body having an upper opening and a plurality of support legs, said support legs attached to a radially outward extending base, said base having a central opening, said support legs having an inner wall, an outer wall and a leg curvature, said inner wall and said outer wall having substantially the same slope, wherein said second chair is substantially disposed inside said first chair when said first and second support legs are aligned.

22. A combination for holding a plurality of chairs used to support reinforcement members, comprising:

a container having an inner wall, a first end and a second end; and a plurality of generally identical chairs, each chair comprising a hollow-conical body having a longitudinal axis, an upper end, a lower end, said chair including a radially outward extending base connected to said body at said lower end, said base having an outer perimeter and an inner perimeter, said inner perimeter defining a circular lower opening larger than said upper end, said chairs being stacked together such that said outer perimeter of said stacked chairs is configured to fit within said inner wall of said container, said chairs being stacked together such that the bases of adjacent chairs are separated by a gap;

wherein said plurality of chairs are stacked in a single stack such that each longitudinal axis of each chair is coincident and the shape of the inner wall of the container is generally shaped like the outer perimeters of said stack, and said lower end of said container including an aperture configured to allow removal of one of said plurality of chairs from said container.

23. The combination of claim 22, further comprising a flexible lip on said first end of said container, said flexible lip defining an aperture sized smaller than said outer perimeter of said base, wherein said lip is configured to flex to allow of one of said plurality of chairs to be removed from said container.

24. The combination of claim 22, wherein said gap between adjacent chairs is less than fifteen percent of a height of one of said plurality of chairs.

25. A method for handling a plurality of chairs used to support reinforcement members within a tubular container, each chair having a longitudinal chair axis and a planar base perpendicular to said chair axis, said base being the widest part of each chair, said tubular container having a first end, a second end, a longitudinal tube axis, said second end of said tubular container including an opening sized to allow one of said plurality of chairs to be removed from said container, said method comprising:

placing said plurality of chairs in a single stack such that each longitudinal axis of each chair is coincident;

storing said stack substantially within said tubular container;

transporting said tubular container proximate a location requiring a chair;

removing one of said plurality of chairs from said tubular container; and placing said chair at said location.

* * * * *

UNITED STATES PATENT AND TRADEMARK OFFICE

CERTIFICATE OF CORRECTION

PATENT NO. : 5,729,949

DATED : March 24, 1998

INVENTOR(S) : D. Hartzheim

It is certified that error appears in the above-identified patent and that said Letters Patent is hereby corrected as shown below:

Column 8, line 39, change "wail portion" to --wall portion--.

Signed and Sealed this

Eighth Day of September, 1998

*Attest:*

*Attesting Officer*

Bruce Lehman

BRUCE LEHMAN

*Commissioner of Patents and Trademarks*